US009394034B2

(12) United States Patent
Mueller

(10) Patent No.: US 9,394,034 B2
(45) Date of Patent: Jul. 19, 2016

(54) FLOATING PLATFORM WITH A TECHNICAL SUPPORT

(76) Inventor: Peter A. Mueller, Gattikon (CH)

( * ) Notice: Subject to any disclaimer, the term of this patent is extended or adjusted under 35 U.S.C. 154(b) by 84 days.

(21) Appl. No.: 14/235,233

(22) PCT Filed: Jul. 25, 2012

(86) PCT No.: PCT/CH2012/000176
§ 371 (c)(1),
(2), (4) Date: May 12, 2014

(87) PCT Pub. No.: WO2013/013333
PCT Pub. Date: Jan. 31, 2013

(65) Prior Publication Data

US 2015/0158559 A1 Jun. 11, 2015

(30) Foreign Application Priority Data

Jul. 25, 2011 (CH) ..... 1249/11

(51) Int. Cl.
*B63B 27/36* (2006.01)
*B63B 27/14* (2006.01)
*B63B 29/04* (2006.01)

(52) U.S. Cl.
CPC ..... *B63B 27/36* (2013.01); *B63B 27/14* (2013.01); *B63B 27/146* (2013.01); *B63B 29/04* (2013.01); *B63B 2027/141* (2013.01); *B63B 2029/043* (2013.01)

(58) Field of Classification Search
CPC ..... B63B 27/14; B63B 17/00; B63B 23/48; B63B 27/36; B63B 29/04; B63B 27/143; B63B 27/146; B63B 27/00; B63B 23/02; B63B 23/32; B63B 23/42; B63B 23/40; B63B 35/40
USPC ..... 114/268, 362, 365, 369, 259; 182/88, 182/91
See application file for complete search history.

(56) References Cited

U.S. PATENT DOCUMENTS

| | | | | |
|---|---|---|---|---|
| 5,904,113 | A | 5/1999 | Slikkers | |
| 6,782,842 | B1 * | 8/2004 | Alvord | 114/369 |
| 7,182,175 | B1 * | 2/2007 | Schmitt et al. | 114/362 |
| 8,061,932 | B1 * | 11/2011 | Latham | B63B 27/36 114/259 |
| 8,944,210 | B2 * | 2/2015 | Sedlack, II | 114/362 |
| 2003/0041792 | A1 | 3/2003 | Besenzoni | |
| 2010/0186657 | A1 | 7/2010 | Muller | |

FOREIGN PATENT DOCUMENTS

| | | | |
|---|---|---|---|
| DE | 42 09 090 | A1 | 10/1992 |
| EP | 2 275 339 | A1 | 1/2011 |
| FR | 2 862 275 | A1 | 5/2005 |
| WO | WO 2006/120593 | A1 | 11/2006 |
| WO | WO 2009/009917 | A2 | 1/2009 |

OTHER PUBLICATIONS

Dec. 7, 2012 International Search Report issued in PCT/CH2012/000176.

* cited by examiner

*Primary Examiner* — Lars A Olson
(74) *Attorney, Agent, or Firm* — Oliff PLC

(57) ABSTRACT

The invention relates to a tender furniture (1) unit which is hollow and contains a fold-out V-support (6) which thus serves as a parking means for a tender (9), and additional technical means (12, 12*a*, 12*b*, 13, 16, 26, 27, 36, 38, 43, 47) and general storage means can be stowed therein and, with no tender (9) is present, the tender furniture unit (1) serves, by means of the backrest (3), as seating, an enlarged platform area or lying area.

14 Claims, 4 Drawing Sheets

FLOATING PLATFORM WITH A TECHNICAL SUPPORT

TECHNICAL FIELD

The invention relates to a furniture unit that is part of a holding means for a tender and can hold other technical means while simultaneously serving as a place for sitting or lying, according to the preamble of the first claim.

PRIOR ART

Tenders, also called dinghies, are placed on V-shaped wedges either on the tender platform or pushed into a tender garage on the interior of the watercraft, which also have a V-shaped shelf part there.

Tenders on davits do not require any underlying elements, since such tenders are hung.

A tender is usually a rubber boat that is motorized or equipped with paddles and serves as a connecting vehicle between the yacht and the shore or as a recreational vehicle, such as for waterskiing, for example. Tenders usually have a V-shaped hull, which is why yachts have commensurate loading means on board. The placing of a tender on or in a yacht is always a problem, since it requires a relatively large amount of space and therefore blocks space for movement on the swim platform, or it requires a garage, for which purpose a cabin has to be sacrificed, or the tender has to be heaved onto the flybridge.

Gangways are attached to the stern of a watercraft and are used as a means for walking to and from the shore, for example as shown in US patent 2003041792 (A1) and mounted as an exception on the swim platform as described in patent WO 2006120593 (A1).

Stairs on the swim platform are used to access the water and, more importantly, to board the craft from the water. Such stairs are also embedded in the swim platform.

DESCRIPTION OF THE INVENTION

The object of the invention is to provide, for a tender platform, a holding means for tenders which has multiple functions, namely as a tender holding means and furniture unit at the same time; i.e., when no tender is parked on the tender platform, the holding means can be provided and the furniture unit can be used as a place to sit or lie and is available as a receiver for a gangway and stairs and as storage.

The placing of a tender is an eternal issue for all owners of watercraft since, on the one hand, one would like to have a tender that is as large as possible which, when submerged, therefore lies calmly in the water but, on the other hand, one would like to have a tender that is as small as possible so that it takes up less space on board the watercraft. The parking philosophies vary greatly, and the invention concentrates on the use of a tender on the stern of a watercraft that is parked on a platform, unlike those in which it is hung behind the stern unit on davits.

Of course, those who use watercraft recreationally want to get the maximum space from their watercraft, which is why the trend is moving in the direction of tender platforms, which are also used as swimming platforms or, in larger yachts, as an additional place for lingering and meeting near the water. The disadvantage is that the stern or the swim platform is taken up by the receiving means for the fixing of the tender and, consequently, do not have a particularly inviting appearance conducive to cozy get-togethers among the tender holding means. Foldaway V-holders exist, but folding chairs and other seating means then need to be hauled from the cockpit or from stow spaces. If a larger wave swashes over and the seating has been left unattended because one is taking a bath in the lake or getting drinks in the cockpit, the chairs and the like are quickly washed away.

In this regard, the invention combines the useful component of the tender rack with the comfort-oriented component of a means for sitting/lying/storage and stairs/gangway that is firmly connected to the tender platform but can be moved or even rotated as needed by means of track means.

Such a furniture unit is multifunctional, in that it has a flap with an opening from which the V-support for the tender can be folded out but is otherwise stowed away out of sight on the inside of the furniture unit. Moreover, the backrest on the furniture unit can be raised and lowered—lowered both in order to enable fixing of the tender as low on the tender platform as possible and to make use of the additional lying area. If the backrest, which can be fixed in various positions, is raised, the furniture unit becomes a spacious bench that can be rendered more comfortable using seawater-resistant cushions. The furniture unit can be opened by means of a cover, which is also a seating element and can be used for the elegant stowing of cushions, armrests, hoisting cranes or a tender lift, a gangway, stairs, among other things, and can even hold an icebox, and the cover can be opened and closed in keyless fashion by means of an RFID chip or remote control.

Furthermore, a large tender lift can be integrated into the furniture unit that is stowed invisibly in the seating group when not being used, and the cover of the seat, besides being used as a gangway and stairs, can be used as emergency stairs by means of a compression spring or the like.

Appearance is an important component in recreational navigation and therefore often requires novel technical solutions in order to even make such things possible at all. In this case, the tender platform and the furniture unit can be covered with a wovan pattern such as those which the Dedon Company, with its artificial fibers, successfully applies to patio furniture, for example. To do this, the tender platform must be provided [with] a solid, corrosion-free underframe, or an existing plastic platform can serve as a underframe for receiving the "basket work." As will readily be understood, other patterns and materials can also be used. In this respect, it is advantageous for the furniture unit itself to have a rigid structure and the pattern to be provided only as a shell that can be pulled over the structure. This enables quick customization and, in the event the covering is damaged, it can be quickly replaced without having to disassemble the entire furniture unit and remove the technical components.

The furniture unit can also be a folding element and rest against the underframe platform like a second platform. Together with fold-out stairs, this combination constitutes a smooth, walkable surface that can be made into seating and stairs/gangway as needed.

According to the invention, this is achieved by the features of the first claim.

The essence of the invention is to provide a furniture unit that is hollow and holds a fold-out V-support and serves as parking means for a tender and additional technical means can be stowed therein, and, when no tender is present, the furniture unit serves as a place to sit or lie, as stairs, a gangway, and general storage.

Additional advantageous embodiments of the invention follow from the sub-claims.

BRIEF DESCRIPTION OF THE DRAWINGS

Exemplary embodiments of the invention will be explained in further detail below with reference to the drawings. Same elements are provided with the same reference symbols in the various figures.

Only the elements that are essential to directly understanding the invention are shown schematically.

MANNER OF CARRYING OUT THE INVENTION

Figure 1:
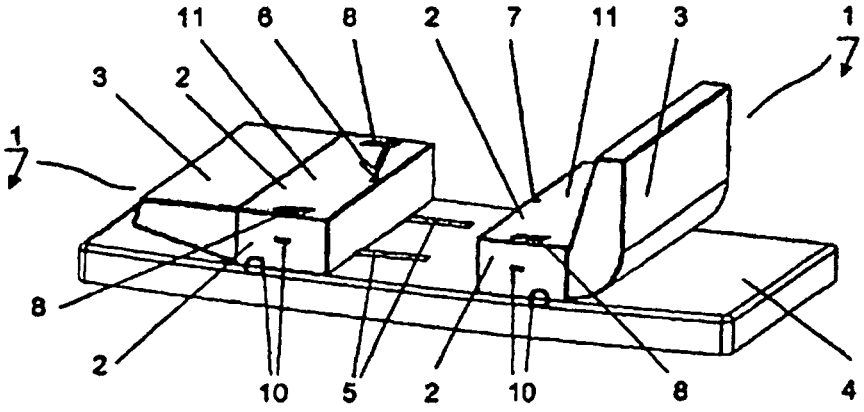
FIG. 1 shows a schematic 3D view of a tender platform with two counter-directional tender furniture units, either fixed or moveable, with lowerable backrest and fold-out V-support and fixing means.

FIG. 1 shows a schematic 3D view of a tender furniture 1 consisting of the seating element 2 and the lowerable backrest 3 on the tender platform 4, fixed or moveable by means of tracks 5, and with fold-down V-support 6 with lead-through 7 and insertion slots 8 for armrests and additional accessories, with two tender furniture units 1 being opposed.

Figure 2:
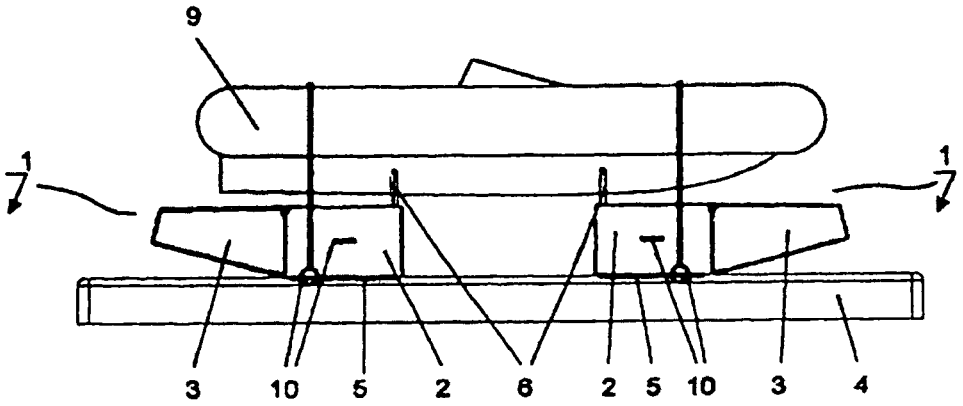
FIG. 2 shows a schematic side view of a tender platform with two counter-directional tender furniture units and recessed backrests, the V-support with tender.

The multifunctional tender furniture 1 is connected to the tender platform 4 in a fixed or moveable manner, which can also be a lowerable tender platform 4, and it is therefore central that tender furniture 1 be solidly anchored, so that it cannot float away or otherwise be lost when submerged. For optimum comfort, it is also advantageous for the tender furniture 1 to have a backrest 3 and be lowerable, so that a tender 9 as shown in FIG. 2 can be positioned right over the seating area of the tender furniture 1 and parked in an ideal manner by means of the V-support 6, which is extended by means of a lifting means (not shown here) from the interior of the seating element 2. The V-angle of the V-support 6 can be adjusted as needed, depending on the deadrise of the tender 9, and the entire thing can be moved laterally as well in order to make space, for example with a small lifting crane that is otherwise stowed in the seating element 2 and can now be activated appropriately in order to place the tender 9 in and remove it from the water. Here, the dual function as a place to sit or lie becomes evident—even with an enlarged lying surface by lowering the backrest 3—and, as needed, as a parking option for a tender 9. Fixing means 10 on the side bolsters of the tender furniture 1 or on the tender platform 4 enable quick lashing of the tender 9 on the stern of a watercraft.

The hinge with the limited rotation is not shown; with it, the backrest 3 forms a level area with the seating element 2 and does not require any outside supports, and the backrest 3 is arranged over the tender platform 4 in a manner that is visually practically floating.

The seating area of the seating element 2 has a cover 11 with a lead-through 7 for the folding-out of the V-support 6, as well as insertion slots 8 for inserting armrests or holders for beverages or the like. The seating element 2 can also be used as a storage means, for example to store the armrests, cushions or even technical means as described in FIG. 3.

The cover 11 can also fold in the direction of the other seating element 2 and, if another surface underlies it, a single large lying space can be created with the two tender furniture units 1.

In order to increase the attractiveness of a lounge attached to the stern in the form of elegant tender furniture 1 units and also to incorporate the tender platform 4 into the design, the elements can be covered by a basket work. For the tender furniture 1, that is prior art and is widely used in patio furniture. What is novel, in contrast, is that the seating element 2 and the backrest 3 constitute stable frames and the basket work is pulled over them by means of a separate shaped frame. As will readily be understood, other patterns and other materials can also be worked and placed over the frames.

The use of such a covering with a wovan look for tender platform 4 is also novel. For this purpose, a seawater-resistant frame with appropriately arranged grid structures is required. A secure underframe is also needed, which can be a stable but thin plastic plate, for example, for imparting greater stability onto the basket work, while always keeping in mind that the platform must remain lightweight and ensuring by means of distributed hole pairs that the water can flow off or trickle through the tender platform 4 in a targeted manner. Instead of a thin plastic plate, a net made of stainless steel can also be used directly.

FIG. 2 shows a schematic side view of a tender platform 4 with two opposed tender furniture 1 units arranged transversely to the tender platform 4, with lowered backrests 3, the two V-supports 6 and with the carried and attached tender 9.

Due to the low seating element 2, which reaches a standard seating height by means of cushions and the folded-back backrest 3, as well as the V-support 6 folded out right over the seating element 2, the tender 9 can be parked with an acceptable height position on the tender platform 4. The moveable seating elements 2 make it possible to hold the tender 9 optimally by means of the V-support 6 and, on the other hand, the seating elements 2 can be moved closer together or farther apart depending on the number of visitors and intended use. The tracks 5 can be mounted on the tender platform 4 or on the seating element 2. One version that is not shown is one in which the seating element 2 can be rotated on its vertical axis by means of a rotating mechanism and therefore assume any position with respect to the tender platform 4 from longitudinal to transverse. When seen from a birds-eye view, the seating elements 2 can also have the shape of a U or L or other shapes.

Figure 3:
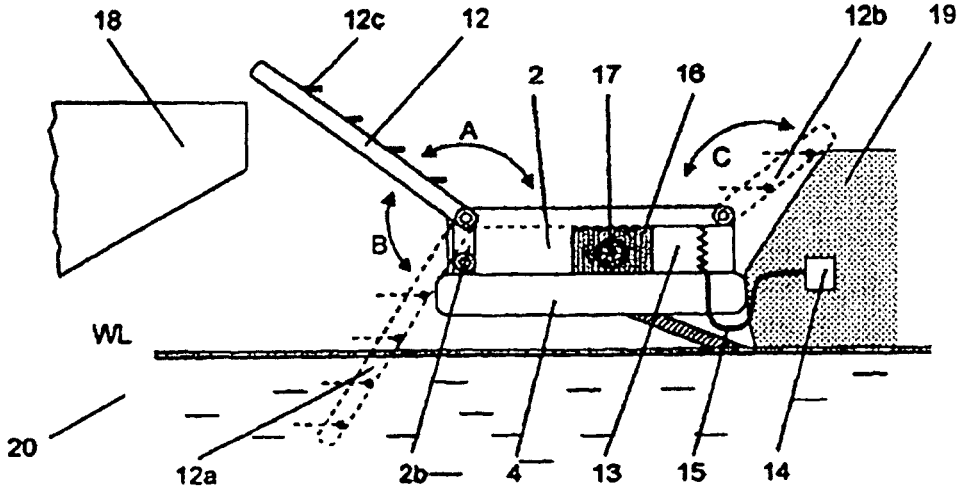
FIG. 3 shows a schematic side view of a tender platform with a furniture unit and, pivoted in it, a gangway with stair function, an icebox with separate cooling device, connected by means of cooling lines, as well as a water-tight box with hydrophobic air exchanger.

FIG. 3 shows a schematic side view of a tender platform 4 behind the watercraft 19 with a seating element 2 and, supported in it, gangway 12 with climbing means 12*a*, small gangway 12*b* and icebox 13 with separate cooling device 14 that is connected to the cooling lines 15, as well as a water-tight box 16 with a hydrophobic air exchanger 17.

In addition to the stowing of the V-support 6, the seating element 2 can also be used to stow other technical means as discussed in relation to FIG. 1 as a protected storage area for a tender crane or for the perfect concealment of a fold-out gangway 12, by means of lowering the cover 11 or the side bolster 2*b*, in order to reach land 18 in a favorable manner. In general, gangways are extremely tedious items and require a very long ramp in order only to extend beyond the tender platform 4, followed by the portion which serves as a bridge between watercraft 19 and land 18. In this configuration, the point of receiving and rotation is at the end of the seating element 2. By folding out the gangway 12 as indicated by the arrow A, the means immediately bridges over the water 20 for the desired path to and from land. Furthermore, the gangway 12 can be tipped downward further according to the arrow B until it reaches the water line WL and serve as stairs 12*a*, for example an aid to return to deck after a short swim in the water 20. For this purpose, the steps are walkable on both sides. As will readily be understood, the gangway 12 can also be telescopic, namely to bridge across larger distances. In that case, the gangway 12 can also be rotating, pivoted about 180°, for example.

To enable comfortable folding-in and -out of the gangway 12, it can be supported by pneumatic springs or hydraulically or electrically, thus also damping the travel speed.

Figure 6:
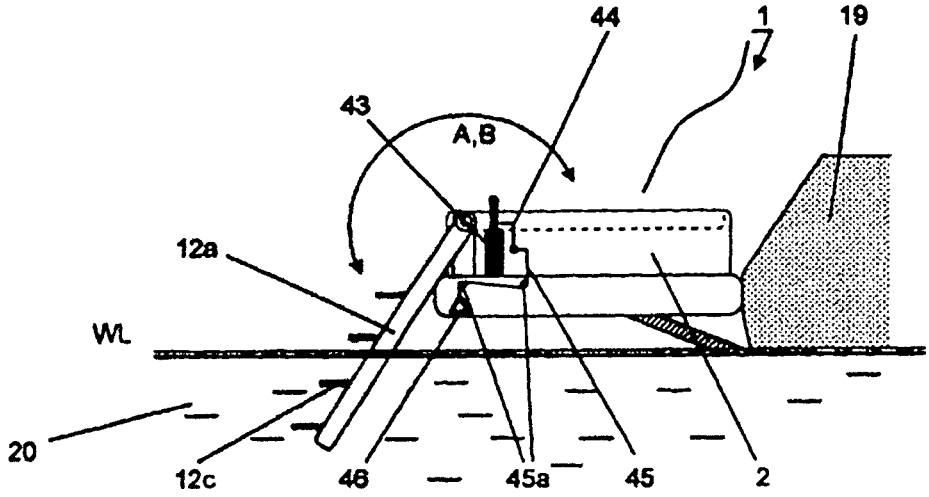
FIG. 6 shows a schematic side view of a tender platform with a furniture unit with a fold-out cover and a cylindrical compression spring.

A small gangway 12*b* is pivoted at the other end of the seating element 2 and serves to form a bridge between the tender platform 4, which can be lowered, for example, as shown in FIG. 6, and the cockpit of the watercraft 19 while still allowing passage up to the cockpit even though the tender platform 4 is lowered.

Moreover, an icebox 13 for beverages and the like can also be installed in the seating element 2. Since the tender platform 4 can also be a lowerable platform, it makes sense to leave the cooling device 14 onboard the watercraft 19 and to transport only the cooling liquid to the icebox 13 by means of flexible cooling lines 15, so that the water-tight icebox 13 does not have any electrical drive on the lowerable tender platform 4, which would otherwise go below the water line WL when a tender is put up or taken down.

The situation is similar with the box 16, which is water-tight in order to store cushions, armrests, etc., which should of course not get unnecessarily wet upon lowering of the tender platform 4, while air exchange should be ensured in the raised position, lest the stored items become moldy. The hydrophobic air exchanger 17, such as that from the Gore Co., is used for this purpose, as it does not allow water in but allows the air to circulate. Known humidity removal means such as those by the 3M Co. support the quality of textile storage.

Figure 4:
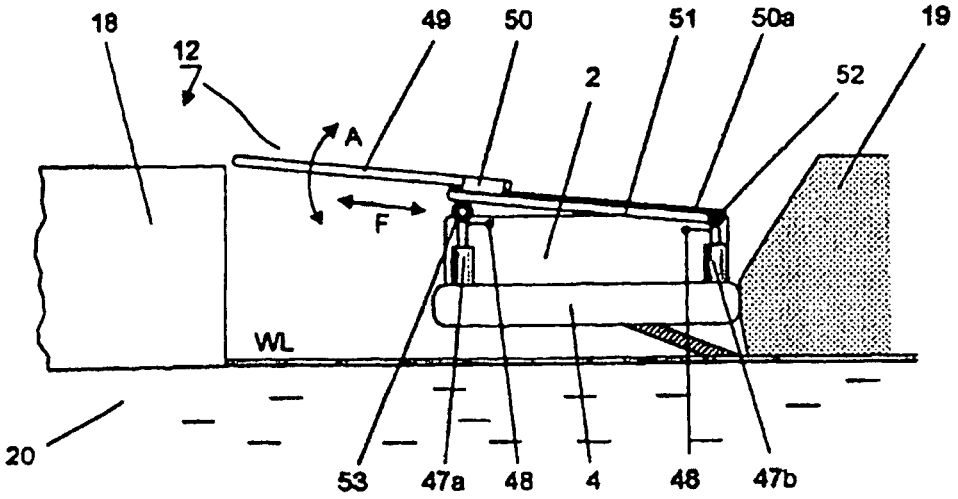
FIG. 4 shows a schematic side view of a tender platform with a furniture unit and, in that, a pivoted, horizontally extendible gangway with two lifting cylinders.

FIG. 4 shows a schematic side view of a tender platform 4 with the seating element 2 and, in that, a pivoted, extendible gangway 12, consisting of the gangway plate 49 and support plate 51 and guided by two lifting cylinders 47.

When not in use, the gangway 12 is stowed completely in the seating element 2. As needed, the cover 11 is folded away and the gangway 12 is pushed up the gangway plate 49 by means of the gas-activated, blockable lifting cylinder 47*a*, which is released by means of the trigger button 48, until it protrudes over the edge of the seating element 2. The gangway plate 49 can be moved horizontally by means of the gangway slide 50, which rests on the support plate 51 according to arrow F. The support plate 51 is guided by means of the track 50*a*, and the support plate 51 also serves as a support element for the support roller 53 mounted on the lifting cylinder 47 and can be set up angularly such that a connection to shore can be established. For additional height-positioning or a lowering position of the gangway plate 49, the rear lifting cylinder 47*b* can also be actuated by a trigger button 48, which has a rotary hinge 52 on which the support plate 51 is pivoted. In order not to use up the full length of the interior space of the seating element 2, the gangway plate 49 can be folded in the middle (not shown here), thus requiring less space in the seating element 2, but have the original size again upon being folded out. Instead of that, a multiple slide function can be established in order to render the entire assembly telescopic for this purpose. The lifting cylinder 47 can of course also be actuated hydraulically or electrically.

Figure 5:
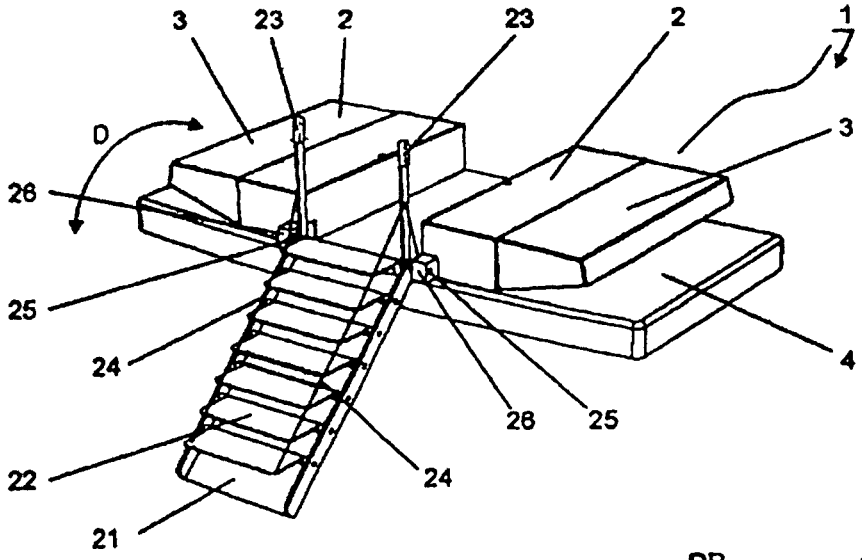
FIG. 5 shows a schematic 3D view of a tender platform with two counter-directional tender furniture units and interposed extendible and fold-out stairs with grip bars and safety ropes.

FIG. 5 shows a schematic 3D view of the tender platform 4 with two counter-directional tender furniture 1 units and interposed extendible and fold-out stairs 21 with the steps 22, supporting rods 23 and safety ropes 24, as well as the swivel joint 25 and the moveable arbor 26.

The abovementioned function of the gangway 12 as a climbing means 12 for climbing into and out of the water 20 is a narrow design compared to amply wide stairs 21, which has adjustable and lockable ample steps 22 that can be folded up to 180°. These are walkable on both sides, so the stairs 21 can also be used as a gangway.

Chiefly, however, the stairs 21 constitute comfortable means for climbing into and out of the water 20 and can also be used as seating in order to feel the water more intensely. The steps 22 are connected to each other cost-effectively by a safety rope 24, which is fixed to the two supporting rods 23, and the supporting rods 23, in turn, are connected to the tender platform 4 by the safety rope 24, for example, so that the entire set of stairs 21 can follow a defined fold-out path D. Upon folding-in of the stairs 21, the supporting rods 23 can be pulled in order to fold the stairs 21 up. Now no longer held by the safety rope 24, the steps 22 are loose and can therefore also be folded, so the stairs 21 can be laid flat onto the tender platform 4.

For safety reasons, no solid objects should project over the tender platform 4; as a result, it is hardly possible, kinematically speaking, for the swivel joint 25 to be folded down sufficiently in a fixed position on the tender platform 4 of the stairs 21, because it would collide with the tender platform 4 after a few angular degrees below the horizontal plane. For this reason, the swivel joint 25 is mounted on a moveable arbor 26, which places the entire kinematics outside of the tender platform 4 so that the stairs 21 can be tilted as desired. Depending on the design, the two arbors 26 can be extended or simultaneously also lowered to a step 22, as described in FIG. 5*a*.

Although such stairs 21 have a relatively low weight, weight can pose a problem nonetheless, especially with wet hands, so the stairs 21 are supported, for example, by pneumatic springs. These are connected directly to the two axes of rotation of the stairs 21 on the swivel joint 25 and to the arbor 26. This results in very substantially easier and safer raising and lowering of the stairs 21, since they support lifting and work against lowering. At the same time, the supporting rods 23 provide a hold to swimming guests. Likewise, it is possible to fold up and fold out the stairs 21 completely by means of hydraulic or electrical control.

Figure 5A:
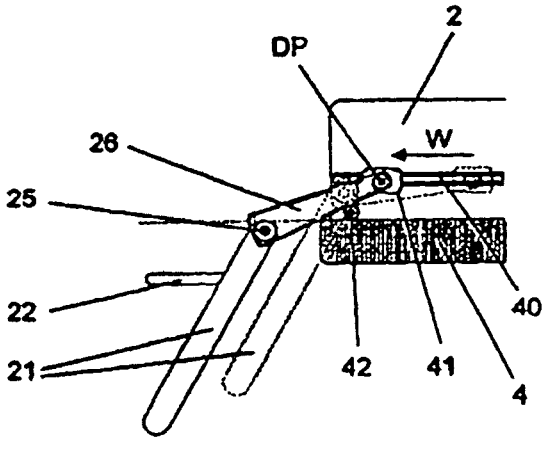
FIG. 5*a* shows a schematic side view of a tender platform with a furniture unit on which moveable, foldable and lowerable stairs are located.

FIG. 5*a* shows a schematic side view of a tender platform 4 with a tender furniture 1 unit on which a slide rail 40 with a slide 41 is attached, and the arbor 26 on the slide 41, which arbor 26 holds the stairs 21 in a pivoted manner, as well as a pulley 42 for guiding the arbor 26.

As pointed out previously, it is difficult to lower truly foldable stairs 21 into the water 20 without making a recess on the tender platform 4, and the stairs 21 can be unattractive nonetheless and also get in the way as a trip hazard, since the point of rotation DP would be located over the tender platform 4. For this reason, the function of the arbor 26 of guiding the stairs 21 over the edge of the tender platform 4 through support with the pulley 42 and then lowering it, for example as a result of the arbor 26 having the shape of a ramp, and upon extension of the arbor 26 with the aid of the slide 41, which is guided on the slide rail 40, the arbor 26 and, consequently, the stairs 21 are automatically lowered mechanically along the path W. The travel path mechanics by means of the slide rail 40, slide 41 and pulley 42, as well as the spring system (not shown here), and the pneumatic springs for the easy folding-up and folding-down of the stairs 21, can be concealed and mounted elegantly and safely in the two opposing seating elements 2.

FIG. 6 shows a schematic side view of a tender platform 4 with a tender furniture unit 4 with a fold-out cover 11 as a climbing means 12*a* and a cylindrical compression spring 43, as well as a trigger 44 with emergency rope 45 and the emergency grip 46.

In principle, every craft 19 should have an emergency ladder so that, if someone is alone and accidentally falls into the water 20, they can save themselves. With its seating element 2, the tender furniture unit 1 is conducive to making a contribution in this regard through the possibility, which was already pointed out in FIG. 3, of using this construction for emergencies as well by means of a fold-up and fold-over cover 11 with mounted steps 12*c*. For this purpose, a compression spring 43 is located in the seating element, for example in the form of a cylindrical body having a spiral spring or a gas as a propellant and a trigger 44 with which the emergency grip 46 mounted under the tender platform 4 can be actuated by means of an emergency rope 45. The emergency grip 46 is guided by means of guide pulleys 45*a* to the appropriate place on the tender platform 4 and held ready there. If someone is then in the water and has nothing to hold onto in order to pull themselves up, they can simply pull on the emergency grip 46 and, as a result of the trigger, which is to say the releasing of the lock on the compression spring 43, the climbing means 12*a* springs up over the cusp and, by means of a compression spring and damper unit (not shown here), it is lowered slowly into the water 20, so that it can be used by the person like a normal swimming ladder. A coiled rope is also conceivable, in which case the person pulls on the trigger 44 and, using muscular force and, for example, the support of a pneumatic spring, folds out the climbing means 12*a*.

Figure 7:
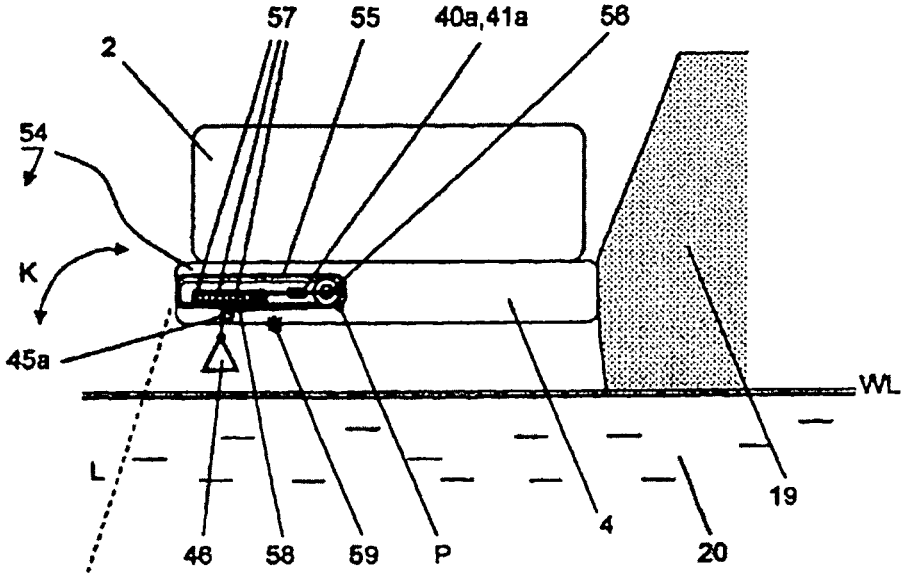
FIG. 7 shows a schematic side view of a tender platform with a furniture unit with a telescopic emergency ladder with rope pull and emergency grip under the tender platform.

FIG. 7 shows a schematic side view of a tender platform 4 with a seating element 2 with a telescopic emergency ladder 54 with an emergency rope 45 and emergency grip 46, which is mounted under the tender platform 4 and has a pull lever 58 and an emergency light 59.

This telescopic emergency ladder 54 is conceived not only for installation in the seating element 2, but especially for the large mass of swimming platforms that should have an emergency ladder in any case for safety reasons. It turns out, however, that an emergency ladder always works quite well on the showroom floor, because the test person is manipulating the emergency ladder at eye level with their feet on solid ground, so the ladder can be triggered accordingly. It is different when the person wants to operate the emergency ladder from the water and hardly has the strength to pull it out.

The solution here is to put an emergency rope 45 into execution here which is mounted directly on the telescopic emergency ladder 54 at attachment point P on the one hand and, by means of a guide pulley 45*a*, the telescopic emergency ladder 54 pulls out practically horizontally, and the swimmer can simply pull on the emergency grip 46 in the vertical direction by means of the guide pulley 45*a*.

The telescopic emergency ladder 54 is accommodated in a housing 55 and supported so as to move easily by means of a slide rail 40*a*, slide 41*a*. Not shown is the lock which ensures that the easily-moving telescopic emergency ladder 54 does not slide back and forth or slide out by itself. The lock is released by pulling on the emergency grip 46 and, after use, the telescopic emergency ladder 54 is pushed by hand back into the housing 55 until the lock snaps in place.

Upon pulling on the emergency grip 46, the telescopic emergency ladder 54 now slides out and tips downward by means of the folding hinge 56, indicated by the arrow K, and the individual rungs 57 of the telescopic emergency ladder 54 extend automatically as a result of gravity and result in a length and angular position, indicated by the broken line L, that enables the swimmer to grasp the telescopic emergency ladder 54 and climb up as comfortably as possible. In terms of safety engineering, the rungs 57 can be equipped with compression springs, so that it is ensured in all cases that the telescopic emergency ladder 54 slides out completely.

As another safety measure, a pull lever 58 is attached to the telescopic emergency ladder 54 that ensures that, in the event that no internal compression springs are present in the rungs 57, the emergency ladder 54 can be extended completely and folded. Upon disengaging of the telescopic emergency ladder 54, a switch can also be actuated automatically that switches an emergency light 59 and illuminates the emergency ladder 54 and/or the pull lever 58 at night, and the emergency light 59 can also be integrated directly in a translucent pull lever 58. Similarly as with emergency swimming vests, the emergency light 59 can emit a certain color and Morse code.

Figure 8:
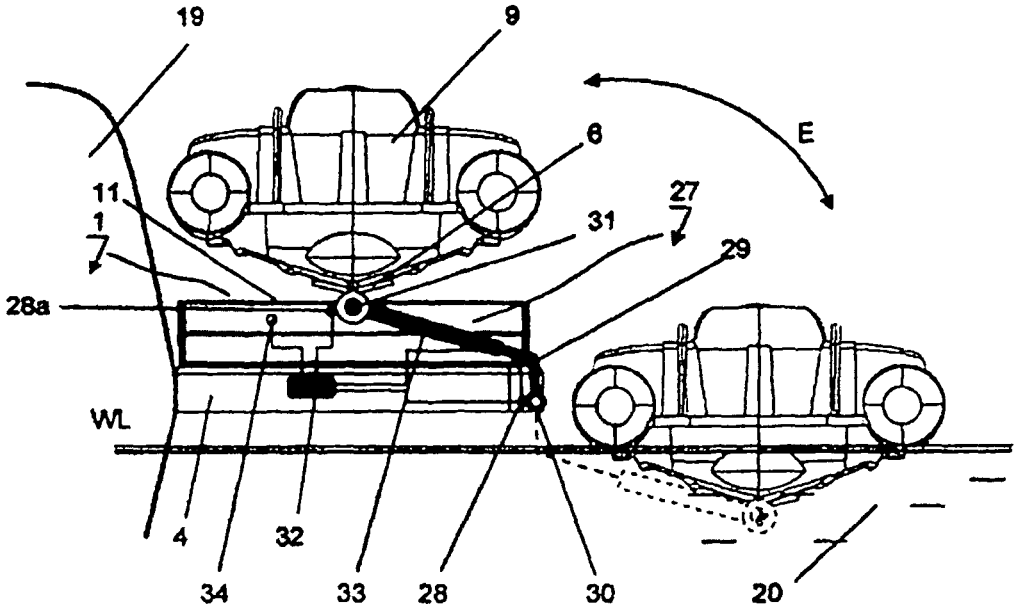
FIG. 8 shows a schematic side view of a tender platform with a furniture unit in which a fold-out tender lift with positionally stable V-support is partially mounted with swivel sensors.

FIG. 8 shows a schematic side view of a tender platform 4 with a tender furniture unit 1 in which a fold-out tender lift 27 engages with the controller 32 with a positionally stable V-support with swivel sensors 28, swivel motor 30, rotary motor 31 and an extension arm 33.

Beside the integration of a small tender crane, the use of a tender lift 27 with a rigid tender platform 4 is a well-disguised system that does not impair the appearance of a watercraft 19. Depending on the side of the craft, the swivel arm 29 can be mounted with the swivel motor 30 within the seating element 2; otherwise, an offset swivel arm 29 under the tender platform 4 is advisable. When the fold-out tender lift 27 is not being used, it is completely hidden under the cover 11. Here, too, the cover 11, which has a removable element, for example, so that the swivel arm 29 and the V-support have space to swivel out, otherwise constitutes a seat and can also be covered with cushioning. The swivel motor 30 generates a rotational movement according to arrow E. A swivel sensor 28 on the swivel motor 30 detects the angle of rotation. Located at the opposite end of the swivel arm 29 is a rotary motor 31, which has a swivel sensor 28*a* and is moved synchronously with the swivel motor 30, i.e., the latter is the master and the rotary motor 31 the slave, with both drives being detected with respect to the angle of rotation by means of the swivel sensors 28, 28*a*, and a controller 32 controls the rotary motor 31 in a commensurately angle-synchronous manner, the swivel movement of the rotary motor 31 being counter to the swivel motor 30. At the same time, the controller 32 also synchronizes the other swivel side with the second swivel arm 29, on which a rotary motor 31 and swivel motor 30 are also mounted, and synchronizes the two swivel motors 30 with respect to each other. The swivel motor 30 and the rotary motor 31 work hydraulically or electrically and can be locked in any swivel position. For example, in the hydraulic version they can be locked with an electrical valve lock on the hydraulic hose, and in the electrical spindle version the spindle can be self-locking or both are driven by a self-locking screw drive, or a sprocket is mounted at the respective point of rotation that can engage by means of a hydraulic or electrical pawl, thus mechanically blocking the rotational movement upon completion of a stroke.

Optionally, a tilt sensor 34 is mounted on the watercraft 19 which, even in swells, keeps the V-support 6 [and] the tender 9 as positionally stable as possible when it placed in the water, i.e., horizontal when viewed from the watercraft 19. This positional compensation is not effective when lying on the tender furniture unit 1, since the V-support 6 assumes a predefined position there which is horizontal with respect to the seating element 2.

Depending on the width of the tender platform 4 or the distance of the tender platform 4 to the water 20 and the immersion depth of the tender 9, the swivel arm 29 may have insufficient reach for putting a tender 9 in and removing it from the water, for which reason a telescopic hydraulic-based or electro-spindle drive-based extension arm 33 is additionally mounted on the swivel arm 29 that is retracted on the stroke side of the tender platform 4 and extended on the lowering side.

Instead of keeping the V-support 6 positionally stable by means of a swivel sensor 28, the connection between swivel motor 30 and rotary motor 31 can be established by means of gearing and a Cardan joint. As needed, the Cardan shaft has a telescopic and rotationally fixed shaft for this purpose, so that the positional stability of the swivel mechanism remains ensured upon extension of the swivel arm 29.

If no extension of the swivel arm 29 is necessary, the swiveling of the swivel arm 29 can also be merely mechanical according to arrow E, such as by means of a chain track that is able to keep the V-support 6 positionally stable by means of a guide pulley even on an offset swivel arm 29 and requires no swivel sensor 28 in this regard.

Figure 9:
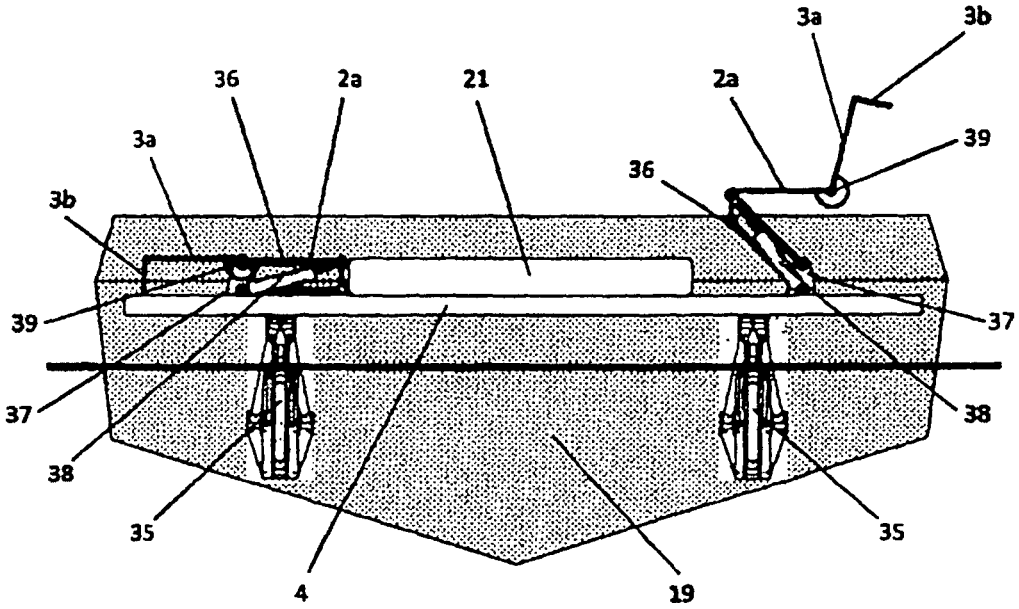
FIG. 9 shows a schematic stern view of a tender platform with two counter-directional foldable furniture units and foldable stairs, with a pair of swivel arms being mounted on the tender platform.

FIG. 9 shows a schematic stern view of a tender platform 4 with two counter-directional folding furniture units 1*a* and foldable stairs 21, with a pair of platform swivel arms 35 being mounted on the tender platform 4.

This version enables a very narrow tender platform 4 that can even be lowered, for example, below the water line WL by means of the platform swivel arms 35. For this purpose, the tender platform 4 has a second platform in the form of fold-out, ample stairs 21 with an assembly 2*a*, 3*a*, 3*b* on the sides having the same height as the stairs 21, for example, thus forming a level surface, but the assembly 2*a*, 3*a*, 3*b* is a folding furniture unit 1 that can be raised on the console 37, for example, by means of a lifting means 36 under it, shown here as a parallelogram, and maintained in the desired position by means of an operating cylinder 38. In addition, the backrest 3*a* can be folded up by means of the hinge 39, which connects the seating element 2*a* to the backrest 3*a* and is lockable, thus lending another use to the assembly 2*a*, 3*a*, 3*b*. Optionally, the backrest 3*b* can also be a support and covering of the assembly 2*a*, 3*a*, 3*b* in the fully lowered position, thus forming a stable, walkable platform.

The operating cylinder 38 can work hydraulically or electrically or be a blockable gas spring. The Bowden cables and locking elements are not shown here.

A fold-out or longitudinally extendible gangway can also be attached beneath or above the seating element 2*a*. This increases the versatility even of this simple seating variant.

Instead of placing the folding furniture units 1*a* on the tender platform 4, the folding furniture units 1*a* can also be integrated into a tender platform 4 having recesses, and areas can also be reserved in the recess that are used for storing objects such as fenders, ropes, anchor, etc.

As will readily be understood, the invention is not limited only to the exemplary embodiments shown and described.

LIST OF REFERENCE SYMBOLS

1 tender furniture
1*a* folding furniture
2, 2*a* seating element
2*b* side bolster
3, 3*a*, 3*b* backrest
2*a*, 3*a*, 3*b* assembly
4 tender platform
5 track
6 V-support
7 lead-through
8 insertion slot
9 tender
10 fixing means
11 cover
12 gangway
12*a* climbing means
12*b* small gangway
12*c* step
13 icebox
14 cooling device
15 cooling lines
16 box
17 air exchanger
18 land
19 watercraft
20 water
21 stairs
22 step
23 supporting rod
24 safety rope
25 swivel joint
26 arbor
27 tender lift
28 swivel sensor
29 swivel arm
30 swivel motor
31 rotary motor
32 controller
33 extension arm
34 tilt sensor
35 platform swivel arm
36 lifting means
37 console
38 operating cylinder
39 hinge
40, 40*a* slide rail
41, 41*a* slide
42 pulley
43 compression spring
44 trigger
45 emergency rope
45*a* guide pulley
46 emergency grip
47 lifting cylinder
48 trigger button
49 gangway plate
50 gangway slide
50*a* track
51 support plate
52 rotary hinge
53 support roller
54 emergency ladder

55 housing
56 folding hinge
57 rung
58 pull lever
59 emergency light
A travel path gangway 12
B travel path climbing means 12*a*
C travel path gangway 12*b*
D travel path stairs 21
E travel path swivel arm 29
WL water line
DP point of rotation
W path
F axial travel gangway plate 49
P attachment point emergency rope 45
K fold-out path

The invention claimed is:

1. A tender platform, wherein a tender furniture unit or a folding furniture unit is mounted on the tender platform or integrated therein, and at least one of a fold-out V-support, gangway, climbing means, tender crane, tender lift, arbors, operating cylinder, icebox, box, emergency ladder, slide, and operating cylinder is embedded, or moveable, height-adjustable, fold-out stairs are attached to the tender platform or the emergency ladder is mounted on the tender platform, wherein the tender furniture unit, including a seating element and a backrest with a lowered backrest and folded-out V-support, serves as a parking area for a tender and, with the V-support folded in, serves as a lying surface for people and, with folded-up backrest, serves as seating.

2. The tender platform as set forth in claim 1, wherein the folding furniture unit has a hinge on the tender platform with which the backrest can be folded up and locked, and the backrest serves as a support when folded down, and the operating cylinder is mounted under the seating element on a lifting means, which is fixed to a console and, together with the fold-out stairs forms a walkable additional platform or a bench seat or group of seats on the tender platform.

3. The tender platform as set forth in claim 1, wherein the seating element has a foldable and/or detachable cover with a lead-through or insertion slots, and/or that stairs are embedded in the seating element that can also be a gangway that can be folded out or rotatable, and the climbing means and the gangway can be telescopic, and/or a lateral recess is present in the seating element for the arbor and swivel joint.

4. The tender platform as set forth in claim 1, wherein the gangway has a moveable gangway plate and a support plate and can be raised from the seating element by means of the lifting cylinder and a rotary hinge, and the gangway can be moved longitudinally, and the height and the tilt angle can be adjusted.

5. The tender platform as set forth in claim 1, wherein the stairs have steps or the pivoted gangway or climbing means has stairs on the seating element that are foldable and walkable on both sides.

6. The tender platform as set forth in claim 5, wherein a swivel joint can be extended and/or lowered on the stairs by means of the arbor and a spring system or a pneumatic spring acts on the swivel joint that supports the stairs when they are being folded up and brake them when they are being lowered, and/or guided supporting rods support the lifting and lowering process and serve as an aid for walking on the stairs, and the stairs and the steps can additionally be held by means of the safety rope in the folded-out and predefined position.

7. The tender platform as set forth in claim 1, wherein the seating element mounted on the tender platform can be moved and/or rotated and stopped by means of tracks, and the seating element can have the shape of a line or a U or an L, or any other shape.

8. The tender platform as set forth in claim 1, wherein a water-tight icebox is embedded in the seating element, and that an electrical cooling device is mounted in the watercraft, and they are connected to each other by means of flexible cooling lines, and that a water-tight box is recessed in the seating element that has a hydrophobic air exchanger.

9. The tender platform as set forth in claim 1, wherein the seating element and the tender platform have a basket wovan pattern that rests on a plastic underframe with drainage holes, and the plastic underframe lies on a corrosion-resistant frame, or that the tender platform has a basket wovan pattern that rests on a stainless net underframe, which lies on a corrosion-resistant frame.

10. The tender platform as set forth in claim 1, wherein the seating element has a frame that is enclosed by means of a collection of colors and patterns, freely selectable plastic covering, or by means of wood.

11. The tender platform as set forth in claim 1, wherein a tender lift with two swivel arms is attached in the seating element or on the tender platform, on which a swivel motor and a rotary motor are mounted which move in an opposite and synchronized manner by means of a controller, and the controller synchronizes the swivel motors with respect to each other, and the V-support is mounted on the rotary motor.

12. The tender platform as set forth in claim 1, wherein swivel sensors are mounted on a swivel motor and on a rotary motor which feed the signals for the angle of rotation to controllers and/or a tilt sensor supports a controller.

13. The tender platform as set forth in claim 1, wherein swivel arms have extension arms that are activated by means of a controller.

14. The tender platform as set forth in claim 1, wherein an emergency ladder is mounted which is extended out of a housing by means of an emergency rope, slide rail, slide, folding hinge, guide pulley and pulling on the emergency grip, and/or a pull lever and/or an emergency light is mounted on the emergency ladder, or a compression spring with a trigger is located in the seating element, connected to the emergency rope and the emergency grip under the tender platform.

* * * * *